United States Patent [19]

Weitzel

[11] Patent Number: 4,660,504

[45] Date of Patent: Apr. 28, 1987

[54] TENSIONABLE SKIVE FOR MAGNETIC BRUSH APPLICATION

[75] Inventor: Richard A. Weitzel, Hilton, N.Y.

[73] Assignee: Eastman Kodak Company, Rochester, N.Y.

[21] Appl. No.: 833,432

[22] Filed: Feb. 24, 1986

Related U.S. Application Data

[63] Continuation of Ser. No. 735,514, May 20, 1985, abandoned.

[51] Int. Cl.[4] ..... G03G 15/09

[52] U.S. Cl. ..... 118/657; 355/3 DD

[58] Field of Search ..... 118/657; 355/3 DD

[56] References Cited

U.S. PATENT DOCUMENTS 3,847,480 11/1974 Fisher ..... 355/15

4,392,735 7/1983 Oka ..... 355/3 DD

OTHER PUBLICATIONS

Xerox Disclosure Journal, vol. 4, No. 6, Nov./Dec. 1979, p. 797; Magnetic Doctor Blade Retractor; Zoltner.

*Primary Examiner*—Bernard D. Pianalto

*Attorney, Agent, or Firm*—Warren W. Kurz

[57] ABSTRACT

Skiving apparatus for use in electrographic copiers for stripping magnetically attractive developer from the outer sleeve of a magnetic brush applicator. Such apparatus comprises an elongated and flexible skive blade and means for applying equal and opposite axial forces at spaced locations along the blade to produce tension in the skive blade and thereby provide a straight skiving edge. Preferably, the skive blade is made of a magnetically attractive material so that it is attracted toward the magnetic core piece of the brush applicator.

9 Claims, 3 Drawing Figures

TENSIONABLE SKIVE FOR MAGNETIC BRUSH APPLICATION

This is a continuation of application Ser. No. 735,514 filed May 20, 1985, now abandoned.

BACKGROUND OF THE INVENTION

1. Field of the Invention

This invention relates to electrographic recording and, more particularly, to apparatus for stripping magnetically attractive developer from the surface of the magnetic brush applicator after being used to develop an electrostatic image.

2. Description of the Prior Art

In the commonly assigned U.S. Pat. No. 4,473,029, issued to Fritz et al, there is disclosed an electrographic development system comprising a magnetic brush applicator and a magnetic development mix. The applicator basically comprises a nonmagnetic cylindrical sleeve having a rotatably driven magnetic core piece positioned therein. The magnetic core piece is driven at a high speed (e.g. 1500 RPM). The magnetic developer comprises a mixture of thermoplastic toner particles and magnetically "hard" carrier particles, the latter having relatively high magnetic coercivity and remanence. Rotational movement of the applicator's core piece serves to transport the development mix over the sleeve's outer surface and into contact with an electrostatic image-bearing surface located at a development zone. While in contact with the image, the electrostatic forces associated with the image overcome the triboelectric attraction between toner and carrier, thereby stripping the toner from the carrier and depositing it on the image to effect development thereof. After development, the partially denuded carrier particles are returned to a reservoir to be replenished with toner particles.

In development systems of the above-mentioned type, some difficulty has been encountered in stripping the developer mix from the applicator's sleeve after development to effect toner replenishment. Owing to the relatively small size of the carrier particles (e.g. 20–40 microns) and their high magnetic affinity for the magnetic core piece located within the sleeve, it is necessary to physically scrape the development mix from the applicator's sleeve in order to achieve separation. For this purpose, it is generally known in the art to use a thin, flexible scraper blade, often referred to as a "skive". For example, U.S. Pat. Nos. 4,338,880 and 4,392,735 disclose skives made from thin strips (30–100 microns thick) of plastic or non-magnetic metal. Such flexible skives are commonly supported along one edge by a rigid member which is positioned to urge the free edge of the skive into contact with the periphery of the applicator's sleeve. Similar skiving devices are disclosed in U.S. Pat. Nos. 4,328,762 and 4,391,503.

Stripping skives of the type disclosed above are sometimes difficult to maintain in alignment and in uniform contact with the periphery of the magnetic brush's non-magnetic sleeve. This is particularly true when the sleeve is rotatably driven. Non-uniform contact produces non-uniform wear of the blade, producing worn spots or "steps" in which developer may become trapped. Moreover, non-uniform contact will produce differential frictional heating which can cause such trapped developer to agglomerate and form large "flakes" which adversely affect image quality.

SUMMARY OF THE INVENTION

In view of the foregoing discussion, an object of this invention is to provide an improved skiving apparatus which is significantly easier to maintain in alignment and in uniform contact with the outer sleeve of a magnetic brush applicator, whereby the above-identified problems are reduced. The skiving apparatus of the invention comprises an elongated and flexible skive, and means for producing tension in the skive to provide a straight scraping edge which, by proper positioning of the tensioning means relative to the magnetic brush sleeve, can contact the sleeve with substantially uniform pressure over its length. According to a preferred embodiment, the blade itself is made of a magnetically attractive material, such as "blue steel", so as to be attracted to the brush sleeve by the internal magnetic forces.

The invention and its various advantages will become more apparent to those skilled in the art from the ensuing detailed description of preferred embodiments, reference being made to accompaying drawings.

DETAILED DESCRIPTION OF THE PREFERRED EMBODIMENTS

Figure 1:
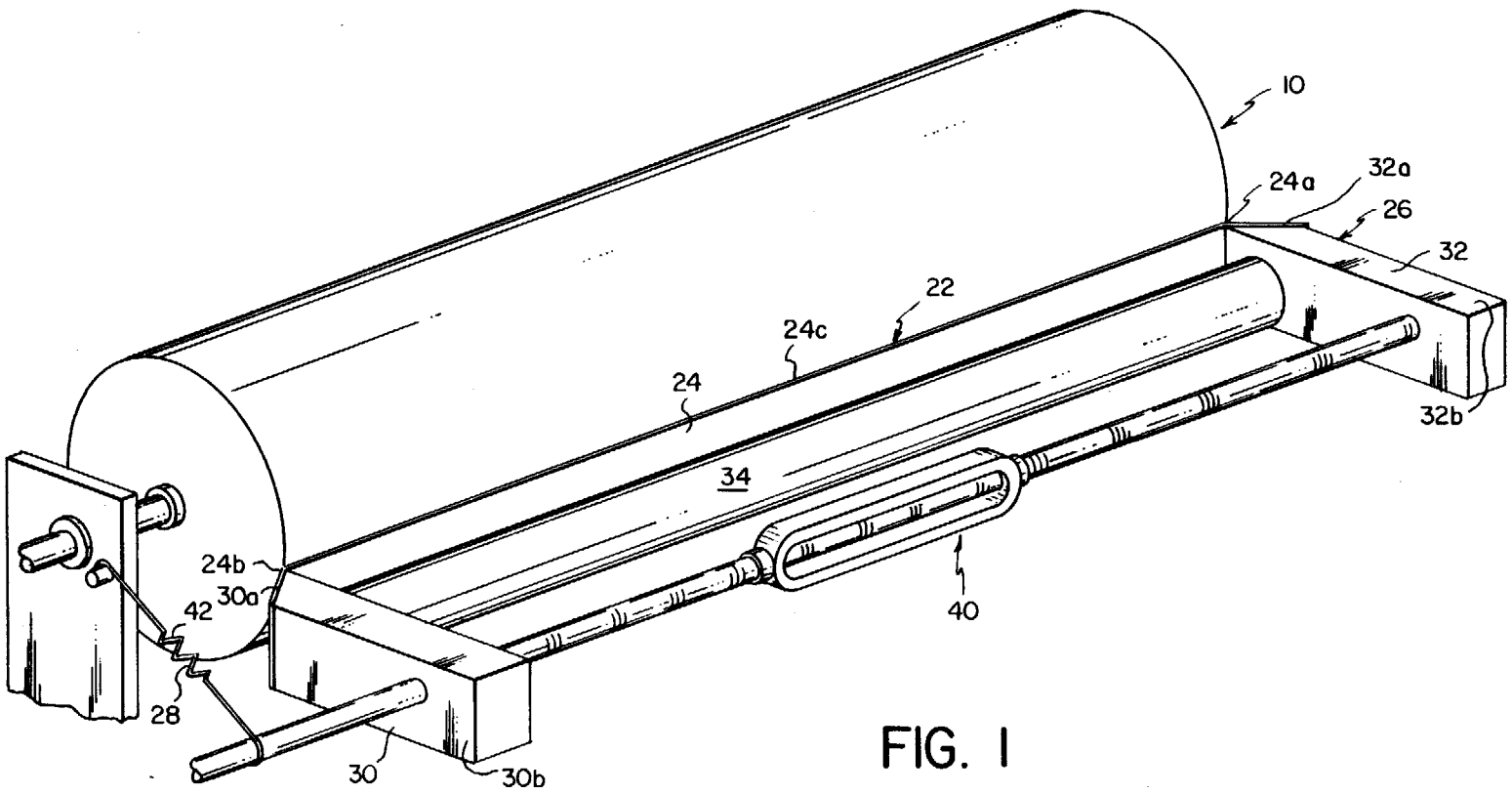
FIG. 1 is a perspective view showing a preferred embodiment of the invention in use with a magnetic brush applicator.
Figure 2:
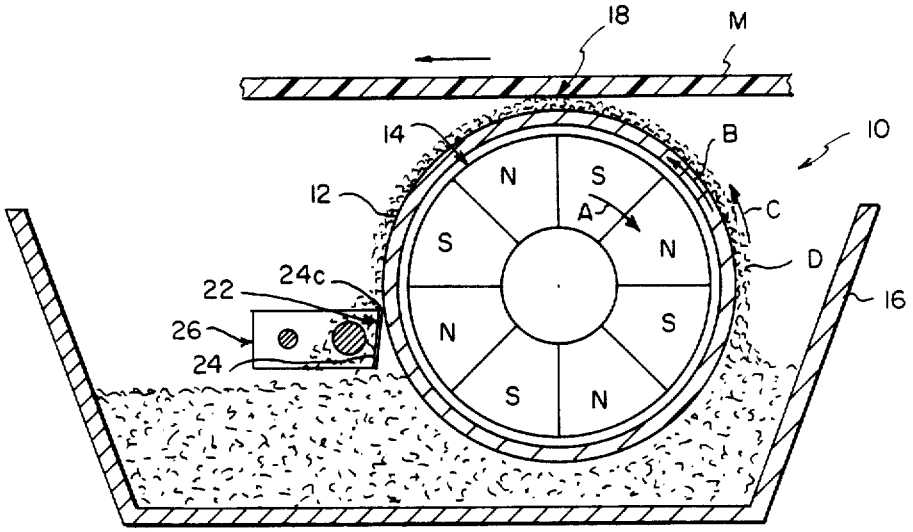
FIG. 2 is a cross-sectional illustration of the apparatus shown in FIG. 1.

Referring to FIGS. 1 and 2, there is shown a magnetic brush applicator 10 of the type commonly used in electrographic copiers for applying a development mix D to a dielectric recording member M to effect development of an electrostatic image formed thereon. Applicator 10 basically comprises a non-magnetic cylindrical sleeve 12 having a multi-pole, magnetic core piece 14 concentrically arranged therein. Conventional drive means (not shown) are provided for rotatably driving core piece 14 in the direction of arrow A, and, optionally, for rotatably driving sleeve 12 in the direction indicated by arrow B. As explained in detailed in the aforementioned patent to Fritz et al (U.S. Pat. No. 4,473,029), the effect of the rotational movement of core piece 14 is to advance magnetic developer over the sleeve surface (in a direction indicated by arrow C) from a reservoir 16 to a development zone 18 at which point the developer contacts the electrostatic image borne by the dielectric recording element M. Developer D may be of the two-component variety comprising a mixture of either magnetic or magnetically-attractive carrier particles and thermoplastic toner particles. Alternatively, the developer could be of the single component type in which the toner particles themselves are magnetically attractive. The apparatus of the invention, as described below, is particularly useful with development systems of the type disclosed in the aforementioned Fritz et al patent. It will be understood, however, that the invention does have utility with a variety of different development systems.

During development of the electrostatic image on recording member M, toner particles are stripped away from their associated carrier particles by the stronger electrostatic forces associated with the charge image.

Thus, it is necessary to replenish the partially denuded carrier particles with additonal toner particles prior to being used again for development. To effect such toner replenishment, it is necessary to physically separate the developer mixture from the outer periphery of shell 12 after development occurs. Toward this end, a tensionable skive blade 22 is provided in accordance with the present invention.

As better shown in FIG. 1, skive blade 22 comprises an elongated strip 24 of flexible and thereby tensionable material. According to a preferred embodiment, such material is a magnetically attractive material, such as "blue steel", having a thickness of between 25 and 250 microns. A preferred width for the skive is between 10 and 50 millimeters. Means 26 are provided for exerting equal but opposite forces (i.e., end loads) at spaced positions 24*a*, 24*b* along the skive blade in order to provide tension in the blade, the function of such tension being to provide a straight, unwavering edge 24*c* which, when brought into contact with the periphery of sleeve 12, will provide uniform pressure along its entire length. While the skive material may be non-magnetic, such as stainless steel or even plastic film, a magnetic material is preferred because of its attraction to the magnetic core piece 14 within sleeve 12. Such magnetic attraction reduces, if not eliminates, the need for mechanically loading the skive in the radial direction, i.e. toward the axis of rotation of the magnetic brush.

Skive-tensioning means 26 may comprise, for example, a pair of end plates 30, 32 which are maintained in spaced relation by a connecting rod 34. The opposite ends of rod 34 are connected to end plates 30, 32 at points intermediate the ends of the plates, thereby providing fulcrum points about which plates 30, 32 may pivot slightly. The opposite ends of the flexible skive strip are connected (e.g. by screws) to beveled edges 30*a*, 32*a* located at one end of their respective end plates. A turnbuckle 40, or the like, is connected between the opposite ends 30*b*, 32*b* of the end plates and serves, when tightened, to exert equal but opposite axial forces on the flexible skive strip 24 to produce a desired tension therein. The skive tensioning means is mounted relative to sleeve 12 so that the tensioned skive strip contacts the sleeve periphery at a location approximately 90 degrees downstream of the development zone 18. A pair of springs 42 (only one being shown) may be provided to urge the skive into contact with the brush sleeve.

Figure 3:
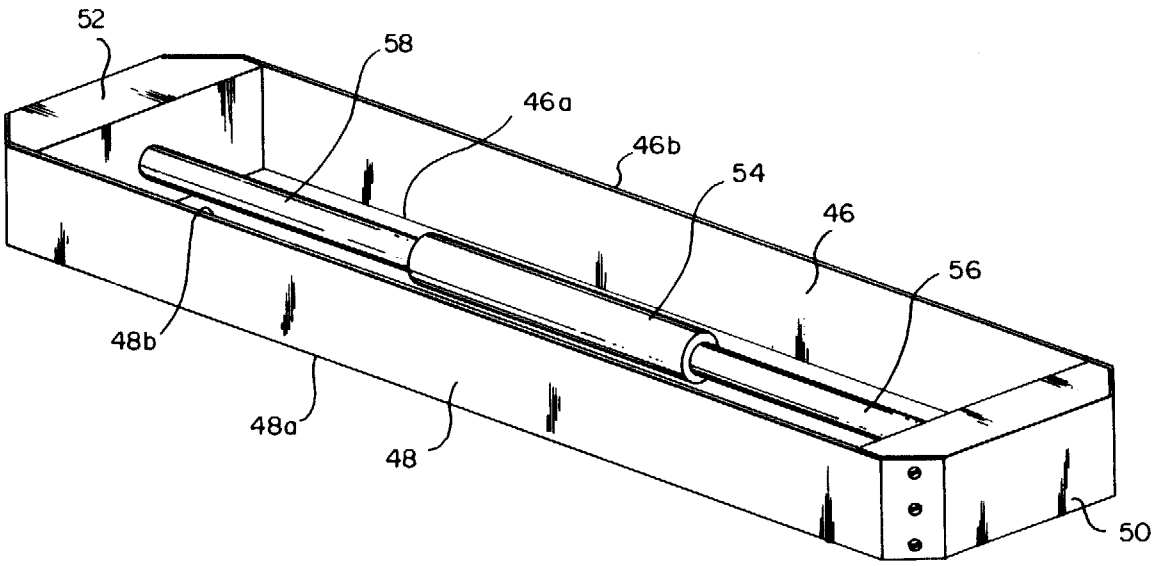
FIG. 3 is a perspective view which illustrates an alternative form of the apparatus of the invention.

Referring to FIG. 3, a variation of the skiving apparatus of the invention is shown to comprise a pair of tensionable skive strips 46, 48, which are connected to and stretch between a pair of spaced plates 50, 52. Tensioning means 54, e.g. a compression spring, serves to exert equal but opposite forces on plates 50, 52 via connecting rods 56, 58. Such an arrangement provides four skiving edges, 46*a*, 46*b*, 48*a* and 48*b*, any one of which can be arranged to contact the applicator sleeve by merely changing the orientation of the assembly relative to the brush applicator.

The invention has been described in detail with particular reference to preferred embodiments thereof, but it will be understood that variations and modifications can be effected within the spirit and scope of the invention.

What is claimed is:

1. In an electrographic magnetic brush applicator system of the type including a cylindrical outer sleeve to which developer is attractible by a magnetic core piece positioned within the sleeve, and means for producing relative movement between the sleeve and core piece to transport such developer between a development zone and a supply, a device for skiving developer from such sleeve comprising a flexible, elongated skive blade, means for tensioning said blade to produce a straight skiving edge, and means for supporting said skiving edge proximate the sleeve periphery.

2. The apparatus as defined by claim 1 wherein said skive blade is magnetically attractive.

3. The apparatus as defined by claim 2 wherein said skive is made of steel having a thickness between 25 and 250 microns.

4. Apparatus for skiving developer from an electrographic magnetic brush applicator, such applicator comprising a cylindrical sleeve to which a magnetically attractive developer adheres by a magnetic core piece positioned within the sleeve, and means for producing relative movement between the sleeve and core piece to advance such developer over the outer surface of the sleeve, said apparatus comprising a flexible, elongated skive blade, tensioning means for applying equal and opposite forces on said blade at spaced locations to produce tension therein, whereby a straight skiving edge is provided, and means for urging said skiving edge into contact with the sleeve periphery.

5. The apparatus as defined by claim 4 wherein said skive blade is magnetically attractive.

6. The apparatus as defined by claim 5 wherein said skive is made of steel having a thickness between 25 and 250 microns.

7. Electrographic development apparatus comprising a magnetic brush applicator having a cylindrical outer sleeve and a magnetic core piece positioned therein, means for producing relative movement between said sleeve and core piece to transport a magnetically attractive developer between a development zone and a developer supply, and skiving means for skiving said developer from said sleeve, said skiving means comprising a flexible, elongated skive blade, tensioning means for tensioning said blade to provide a straight skiving edge, and means for supporting said skiving edge proximate the sleeve periphery.

8. The apparatus as defined by claim 7 further comprising means for biasing said skiving edge toward said sleeve periphery.

9. The apparatus as defined by claim 7 wherein said blade is magnetically attractive, whereby said blade is urged into contact with said sleeve periphery by said magnetic core piece.

* * * * *

UNITED STATES PATENT AND TRADEMARK OFFICE

CERTIFICATE OF CORRECTION

PATENT NO. : 4,660,504

DATED : April 28, 1987

INVENTOR(S) : Richard A. Weitzel

It is certified that error appears in the above-identified patent and that said Letters Patent are hereby corrected as shown below:

Claims 1, 4 and 7 should read as follows:

1. In an electrographic magnetic brush applicator system of the type including a cylindrical outer sleeve to which developer is attractable by a magnetic core piece positioned within the sleeve, and means for producing relative movement between the sleeve and core piece to transport such developer between a development zone and a supply, a device for skiving developer from such sleeve, said device comprising a flexible, elongated skive blade, tensioning means for exerting equal but opposite longitudinal forces on said blade to produce a straight skiving edge, and means for supporting said skiving edge proximate the sleeve periphery.

Claim 4, line 32, after "opposite" insert — longitudinal —.

7. Electrographic development apparatus comprising a magnetic brush applicator having a cylindrical outer sleeve and a magnetic core piece positioned therein, means for producing relative movement between said sleeve and core piece to transport a magnetically attractive developer between a development zone and a developer supply, and skiving means for skiving said developer from said sleeve, said skiving means comprising a flexible, elongated skive blade, tensioning means for exerting equal but opposite longitudinal forces on said blade to provide

UNITED STATES PATENT AND TRADEMARK OFFICE

CERTIFICATE OF CORRECTION

PATENT NO. : 4,660,504

DATED : April 28, 1987

INVENTOR(S) : Richard A. Weitzel

It is certified that error appears in the above-identified patent and that said Letters Patent is hereby corrected as shown below:

a straight skiving edge, and mean for supporting said skiving edge proximate the sleeve periphery.

Signed and Sealed this

Fifth Day of July, 1988

*Attest:*

*Attesting Officer*

DONALD J. QUIGG

*Commissioner of Patents and Trademarks*